United States Patent [19]

Edwards

[11] 3,961,216

[45] June 1, 1976

[54] SHEET METAL BASE FOR PINCH SEALED ELECTRIC LAMP

[75] Inventor: Preston G. Edwards, Sagamore Hills, Ohio

[73] Assignee: General Electric Company, Schenectady, N.Y.

[22] Filed: Jan. 2, 1975

[21] Appl. No.: 537,856

[52] U.S. Cl. ..... 313/51; 313/318; 339/144 R; 339/256 R; 220/2.1 R; 174/50.51; 174/50.52; 174/50.59; 174/17.08

[51] Int. Cl.[2] ..... H01J 5/48

[58] Field of Search ..... 313/51, 49, 318; 339/144 R, 256 R, 278 L; 220/2.1 R; 174/50.51, 50.52, 50.59, 17.08

[56] References Cited

UNITED STATES PATENTS 2,705,310 3/1955 Hodge ..... 339/144

3,001,097 9/1961 Smialek ..... 313/318

*Primary Examiner*—John Kominski
*Assistant Examiner*—Darwin R. Hostetter
*Attorney, Agent, or Firm*—Ernest W. Legree; Lawrence R. Kempton; Frank L. Neuhauser

[57] ABSTRACT

A one-piece sheet metal base for a tubular lamp having pinch-sealed ends is adapted to be simply pushed onto the lamp end by hand. It comprises a flat portion having longitudinally extending side wall portions exceeding slightly in height the thickness of the pinch seal with inwardly turned underbeveled extensions which resiliently grip the pinch seal for frictional retention. A distal end wall portion has a forwardly turned lip adapted to overlie a pigtail attached to the inlead. Mitered corners on the underbeveled extensions and on the end wall provide a passage for threading the pigtail through the base.

10 Claims, 3 Drawing Figures

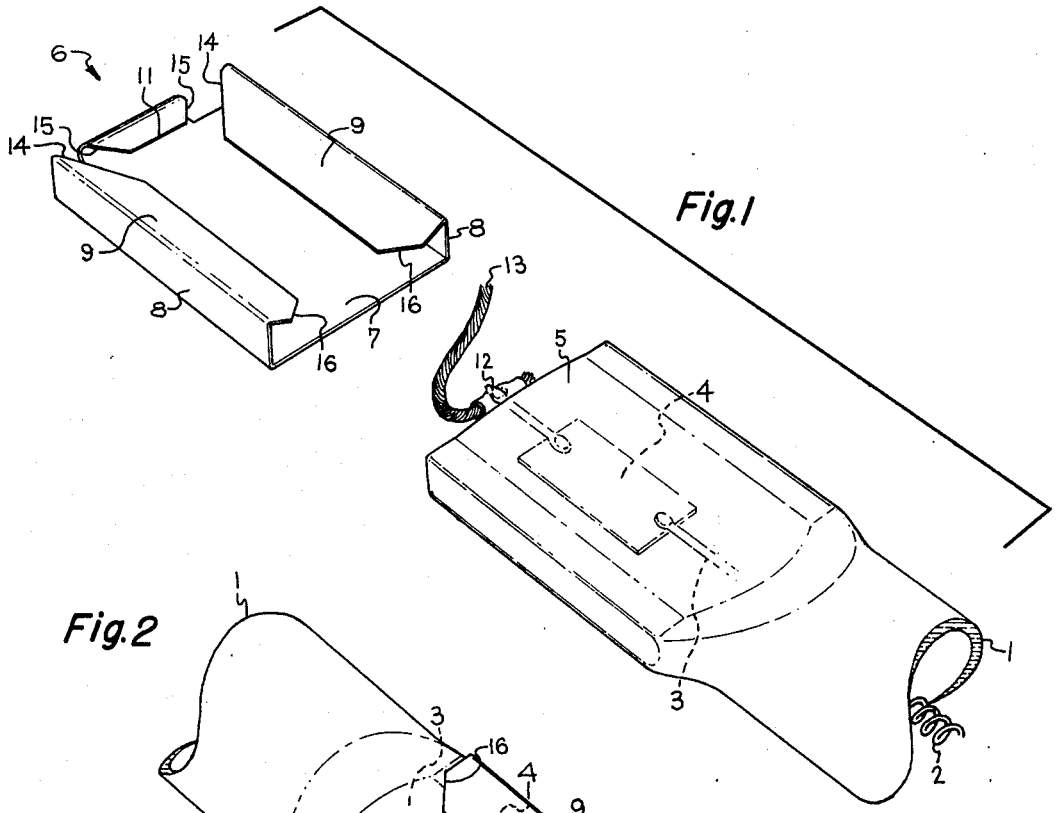
Fig.1
Fig.2
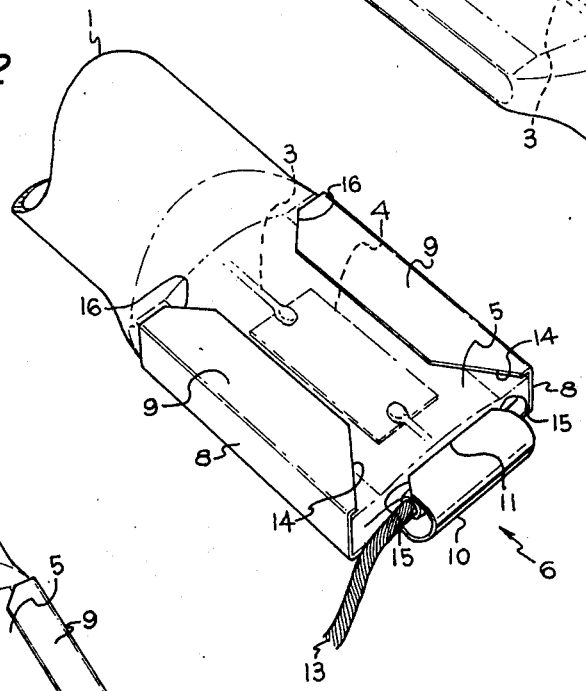
Fig.3
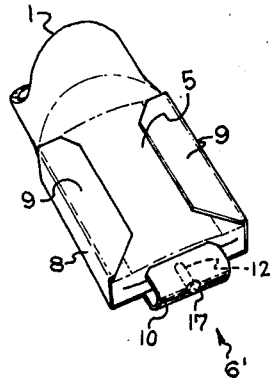

SHEET METAL BASE FOR PINCH SEALED ELECTRIC LAMP

BACKGROUND OF THE INVENTION

The invention relates to metal base terminals for electric lamps and devices having sealed envelopes of vitreous material provided with an externally extending flat pinch seal at an end. It is particularly useful with tubular double-ended incandescent lamps and heat lamps of the tungsten halogen cycle kind utilizing fused silica envelopes. In such lamps the inleads generally include extremely thin flattened ribbon or foil portions which are embedded in and sealed through the wall of the fused silica envelope by collapsing and fusing the silica firmly around the foil in a so-called flat pinch seal. In use, the lamp is generally supported by accommodating the pinch seals at each end in spring metal support clips which may also serve as current connectors to the inleads.

It has been the general practice up to now to provide a base terminal comprising a thin-walled metal sleeve wrapped and clamped around the pinch seal to facilitate accommodating the pinch seal in the spring support clip. In one construction the base is connected to the externally projecting portion of the inlead which then serves as a terminal. In another construction a flexible pigtail is connected to the inlead and the function of the base then is primarily mechanical and decorative. Such base terminals are described in U.S. Pat. No. 2,705,310 — Hodge, and comprise a flattened metal sleeve which is stretched tightly around the pinch seal by folding or welding together a seam along one side.

The mounting of bases of the foregoing kind on the lamp ends is rather laborious and there is inevitably some shrinkage by cracking of seals during assembly. The object of the invention is to provide an improved base structure serviceable also as a terminal, which is low in cost, easily assembled, and reliable in service.

SUMMARY OF THE INVENTION

The invention provides a one-piece sheet metal base for a tubular lamp having a pinch-sealed end which is adapted to be simply pushed onto the lamp end by hand and frictionally retained. It comprises a flat portion corresponding approximately in size to the flat side of the pinch seal, longitudinally extending upstanding wall portions on opposite sides exceeding slightly in height the thickness of the pinch seal and having inwardly turned underbeveled extensions which resiliently grip the pinch seal for frictional retention. A distal end wall portion has a forwardly turned extension or lip adapted to overlie an externally projecting portion of the inlead.

If the function of the base is simply mechanical and decorative, a flexible pigtail is welded to the end of the inlead and the distal end wall then covers up the weld junction. The corners of the underbeveled extensions next the end wall and those of the forwardly turned extension of the end wall are preferably mitered to provide a passage for threading the pigtail through the base. If the base is to serve as a terminal in addition to its mechanical function, the inlead is welded to the distal end wall.

DESCRIPTION OF DRAWING

In the drawing wherein like symbols denote corresponding parts in the several views:

FIG. 1 is an exploded perspective view of the base and the end of the lamp on which it is to be accommodated.

FIG. 2 is a perspective view of a similar base mounted on the opposite end of the lamp.

FIG. 3 illustrates a variant wherein the base serves as electrical terminal.

DETAILED DESCRIPTION

Referring to the drawing, there are shown the ends of an electric lamp comprising a tubular elongated vitreous envelope 1 through which extends a tungsten filament 2 connected at opposite ends to inlead conductors 3 having intermediate foil sections 4 hermetically sealed through the vitreous material of the envelope in flattened pinch seals 5. In an incandescent lamp for illumination purposes, the envelope is generally made of clear, fused silica. For heat lamps or sealed infrared heaters, cheaper translucent fused silica is commonly used. Quartz-like glasses and other high temperature glasses may be substituted for fused silica in applications of lower heat stress.

The base 6 (or 6') according to the invention, comprises a single piece of thin sheet material, suitably stainless steel, of which the main part is a flat portion 7 corresponding in size to the substantially flat pinch seal. Extending longitudinally along opposite sides of the flat portion are upstanding wall portions 8 exceeding slightly in height the thickness of the pinch seal and having inwardly turned extensions 9 which are bent down or downwardly inclined in order to resiliently grip the pinch seal. In the preferred embodiment illustrated, the turned over portions 9 form underbeveled rails angled down toward the flat portion 7 of the base and adapted to frictionally engage the pinch seal. An end wall portion 10 of less height than the thickness of the pinch seal is provided at the distal or outer end of the base. It includes a forwardly turned portion or lip 11 adapted to abut the end of the pinch seal and overlie the externally projecting portion 12 of the inlead conductor 3.

The end wall 10 does not extend the full width of the base whereby a gap or opening is left in each corner which allows the egress of a flexible wire or pigtail 13 welded to inlead portion 12 to serve as a circuit connector. The rear corners of rails 9 are mitered at 14 as are also the corners of end wall lip 11 at 15. The gap between the mitered edges serves as a passage through which pigtail 13, turned up as shown in FIG. 1, may be threaded when the base is pushed onto the end of the lamp.

Pinch seals may vary slightly in size due to such variables as tolerances in wall thickness of the original fused silica tubing, the intensity setting of the sealing fires, and the adjustment of the pinching jaws on the pinch sealing machine. It is desirable to pinch the lamp end between confined jaws so that the width of the pinch is invariant. Accordingly the flat portion of the base is dimensioned to accommodate the width of the pinch between the walls 8. Since the pinch width is a constant, tolerances in silica wall thickness become variations in pinch thickness. To accommodate such variations, wall portions 8 have a height exceeding the thickest pinch seal which the tolerances permit. The underbeveled rails 9 are made wide enough and angled down so as to frictionally engage the thinnest pinch seal which the tolerances permit. The partial miter or rounding of the front corners of the rails at 16 is desirable to facilitate the initial upward flexing of the rails when pushing the base onto the pinch seal.

The functions of base 6 illustrated in FIGS. 1 and 2 are primarily mechanical and decorative. It facilitates engagement of the lamp ends in the metal support clips of the fixture. The manufacturer's name or trademark may be embossed or printed on the outside of flap portion 7 along with the lamp designation or rating, and the base gives a finished appearance to the lamp. The distal end wall portion 10 serves as a shield over any sharp ends and covers the unsightly weld where pigtail 13 is joined to inlead portion 12.

FIG. 3 illustrates a variant of the invention wherein base 6' serves as electrical terminal in addition to its other functions. A central aperture is provided within end wall 10 and external portion 12 of the inlead is cut slightly longer so as to project through the aperture. After the base is slipped over the pinch seal, the projecting portion of the inlead is welded to the distal end wall at 17 so as to make a low resistance connection. In this arrangement base 6' serves as the electrical terminal and the pigtail is eliminated.

The improved base according to the invention is readily pushed onto the pinch seal of electric lamps by hand, and manufacturing experience shows that shrinkage from the mounting operation is substantially eliminated.

The foregoing description of preferred species is intended as illustrative of the invention only, and the base and terminal structure may be modified within the spirit of the invention.

What I claim as new and desire to secure by Letters Patent of the United States is:

1. A sheet metal base for a vitreous lamp envelope containing electric energy translation means and having a flat pinch seal at one end through which an inlead conductor connected to said translation means has a portion projecting externally, said base comprising:

a flat portion corresponding approximately in size to the flat side of said pinch seal, longitudinally extending side wall portions exceeding in height the thickness of said pinch seal and having inwardly turned and downwardly inclined extensions adapted to resiliently engage the pinch seal, and a distal end wall adapted to overlie the externally projecting portion of said inlead.

2. A base as in claim 1 wherein the inwardly turned extensions of the side walls form underbeveled rails angled down to frictionally engage the pinch seal.

3. A base as in claim 1 wherein the distal end wall has a forwardly turned lip adapted to abut the end of the pinch seal.

4. A base as in claim 1 wherein the inwardly turned extensions of the side walls form underbeveled rails angled down to frictionally engage the pinch seal, and the distal end wall is of less height than the thickness of the pinch seal and has a forwardly turned lip adapted to abut the end of the pinch seal.

5. A base as in claim 4 wherein the end wall is narrower than the width of the base and gaps are left in the corners between the rails of the side walls and the lip of the end wall through which a pigtail attached to the externally projecting portion of the inlead may be threaded while pushing said base onto the pinch seal of a lamp.

6. A base as in claim 5 wherein the forward corners of the rails are mitered or rounded to facilitate initial upward flexing of the rails when pushing the base onto the pinch seal of a lamp.

7. In combination, an electric lamp comprising a vitreous lamp envelope containing electric energy translation means and having a flat pinch seal at one end through which an inlead conductor connected to said translation means has a portion projecting externally, and a one-piece sheet metal base comprising a flat portion corresponding approximately in size to the flat side of said pinch seal, longitudinally extending upstanding wall portions on opposite sides of the flat portion exceeding in height the thickness of said pinch seal, said wall portions having inwardly turned underbeveled rails which resiliently and frictionally engage the pinch seal, and an upstanding distal end wall portion having a forwardly turned lip overlying the externally projecting portion of said inlead.

8. A combination as in claim 7 wherein the distal end wall portion is of less height than the thickness of the pinch seal and its forwardly turned lip abuts the end of the pinch seal.

9. A combination as in claim 7 wherein a pigtail connector is fastened to the externally projecting portion of the inlead, and adjacent corners of side wall rail and end wall lip are mitered to provide a threading passage for said pigtail.

10. A combination as in claim 6 wherein the end wall portion is apertured and the end of the externally projecting portion of the inlead projects therethrough and is welded to said end wall.

* * * * *